US007101623B2

(12) United States Patent
Jordan et al.

(10) Patent No.: US 7,101,623 B2
(45) Date of Patent: Sep. 5, 2006

(54) EXTENSIBLE AND ELASTIC CONJUGATE FIBERS AND WEBS HAVING A NONTACKY FEEL

(75) Inventors: Joy F. Jordan, Marietta, GA (US); Renette E. Richard, Dunwoody, GA (US); Christian L. Sanders, Decatur, GA (US); Varunesh Sharma, Atlanta, GA (US); Stephen M. Englebert, Woodstock, GA (US); Bryon P. Day, Canton, GA (US); Andy C. Chang, Lake Jackson, TX (US); Hong Peng, Lake Jackson, TX (US); Jozef J. I. Van Dun, Bellaire, TX (US); Randy E. Pepper, Lake Jackson, TX (US); Edward N. Knickerbocker, Lake Jackson, TX (US); Antonios K. Doufas, Lake Jackson, TX (US); Rajen M. Patel, Lake Jackson, TX (US)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 11/068,098

(22) Filed: Feb. 28, 2005

(65) Prior Publication Data

US 2005/0221709 A1 Oct. 6, 2005

Related U.S. Application Data

(60) Provisional application No. 60/554,482, filed on Mar. 19, 2004.

(51) Int. Cl.
*D01F 8/00* (2006.01)

(52) U.S. Cl. ..... 428/370; 428/373; 428/374

(58) Field of Classification Search ..... 428/373, 428/370, 374; 442/327, 362, 396, 382; 604/358
See application file for complete search history.

(56) References Cited

U.S. PATENT DOCUMENTS

| | | | | |
|---|---|---|---|---|
| 3,423,255 | A | 1/1969 | Joyce | |
| 3,485,706 | A | 12/1969 | Evans | |
| 3,520,861 | A | 7/1970 | Thomson et al. | |
| 3,692,618 | A | 9/1972 | Dorschner et al. | |
| 3,802,817 | A | 4/1974 | Matsuki et al. | |
| 3,849,241 | A | 11/1974 | Butin et al. | |
| 4,041,203 | A * | 8/1977 | Brock et al. | 428/157 |
| 4,115,620 | A * | 9/1978 | Gupta et al. | 428/374 |
| 4,322,027 | A | 3/1982 | Reba | |
| 4,340,563 | A | 7/1982 | Appel et al. | |
| 4,381,781 | A | 5/1983 | Sciaraffa et al. | |
| 4,563,392 | A * | 1/1986 | Harpell et al. | 428/394 |

(Continued)

FOREIGN PATENT DOCUMENTS

EP 0515203 A2 11/1992

(Continued)

OTHER PUBLICATIONS

MicroPatent Abstract, JP 10266056 A, Oct. 6, 1998, OJI Paper Co Ltd.

(Continued)

*Primary Examiner*—N. Edwards

(57) ABSTRACT

Extensible bicomponent fibers and webs particularly adapted for disposable personal care product component applications. Sheath/core configurations providing desirable feel properties for elastic embodiments when compared with conventional elastic fibers and webs are obtained with specific olefin polymer combinations and sheath configurations.

20 Claims, 11 Drawing Sheets

U.S. PATENT DOCUMENTS

| | | | | |
|---|---|---|---|---|
| 4,599,392 | A | 7/1986 | McKinney et al. | |
| 4,663,220 | A | 5/1987 | Wisneski et al. | |
| 4,668,566 | A | 5/1987 | Braun | |
| 4,695,503 | A * | 9/1987 | Liu et al. | 428/207 |
| 4,741,941 | A | 5/1988 | Englebert et al. | |
| 4,766,029 | A * | 8/1988 | Brock et al. | 442/382 |
| 4,818,587 | A * | 4/1989 | Ejima et al. | 428/198 |
| 4,822,668 | A * | 4/1989 | Tanaka et al. | 442/396 |
| 4,830,904 | A * | 5/1989 | Gessner et al. | 428/219 |
| 4,900,857 | A * | 2/1990 | Klett | 556/405 |
| 4,908,251 | A * | 3/1990 | Iimura et al. | 428/68 |
| 4,939,016 | A | 7/1990 | Radwanski et al. | |
| 4,948,841 | A * | 8/1990 | Kasahara et al. | 525/240 |
| 4,988,781 | A | 1/1991 | McKinney et al. | |
| 5,002,815 | A * | 3/1991 | Yamanaka et al. | 428/109 |
| 5,082,720 | A * | 1/1992 | Hayes | 442/362 |
| 5,108,820 | A | 4/1992 | Kaneko et al. | |
| 5,188,885 | A | 2/1993 | Timmons et al. | |
| 5,272,236 | A | 12/1993 | Lai et al. | |
| 5,278,272 | A | 1/1994 | Lai et al. | |
| 5,322,728 | A | 6/1994 | Davey et al. | |
| 5,336,552 | A | 8/1994 | Strack et al. | |
| 5,352,518 | A | 10/1994 | Muramoto et al. | |
| 5,380,810 | A | 1/1995 | Lai et al. | |
| 5,382,400 | A | 1/1995 | Pike et al. | |
| 5,384,373 | A | 1/1995 | McKinney et al. | |
| 5,425,987 | A | 6/1995 | Shawver et al. | |
| 5,472,775 | A | 12/1995 | Obijeski et al. | |
| 5,645,542 | A | 7/1997 | Anjur et al. | |
| 5,726,103 | A | 3/1998 | Stahl et al. | |
| 5,736,465 | A | 4/1998 | Stahl et al. | |
| 5,804,286 | A | 9/1998 | Quantrille et al. | |
| 5,883,188 | A | 3/1999 | Hwang et al. | |
| 5,910,224 | A | 6/1999 | Morman | |
| 5,997,981 | A | 12/1999 | McCormack et al. | |
| 5,997,989 | A | 12/1999 | Gessner et al. | |
| 6,010,588 | A | 1/2000 | Stahl et al. | |
| 6,060,636 | A | 5/2000 | Yahiaoui et al. | |
| 6,117,803 | A | 9/2000 | Morman et al. | |
| 6,140,442 | A | 10/2000 | Knight et al. | |
| 6,176,952 | B1 | 1/2001 | Maugans et al. | |
| 6,225,243 | B1 | 5/2001 | Austin | |
| 6,274,238 | B1 * | 8/2001 | DeLucia | 428/373 |
| 6,323,389 | B1 | 11/2001 | Thomas et al. | |
| 6,342,565 | B1 | 1/2002 | Cheng et al. | |
| 6,417,122 | B1 | 7/2002 | Newkirk et al. | |
| 6,420,285 | B1 | 7/2002 | Newkirk et al. | |
| 6,461,133 | B1 | 10/2002 | Lake et al. | |
| 6,500,540 | B1 | 12/2002 | Langohr et al. | |
| 6,528,439 | B1 | 3/2003 | Stokes et al. | |
| 6,534,612 | B1 * | 3/2003 | Lai et al. | 526/348 |
| 6,541,403 | B1 | 4/2003 | Billarant et al. | |
| 6,906,160 | B1 * | 6/2005 | Stevens et al. | 526/326 |
| 6,960,635 | B1 * | 11/2005 | Stevens et al. | 526/326 |
| 2001/0038912 | A1 | 11/2001 | Billarant et al. | |

FOREIGN PATENT DOCUMENTS

| | | |
|---|---|---|
| EP | 0622380 A1 | 11/1994 |
| EP | 0748846 A2 | 12/1996 |
| EP | 0875609 A2 | 11/1998 |
| EP | 0924322 A1 | 6/1999 |
| EP | 0805881 B1 | 5/2002 |
| EP | 0672775 B1 | 6/2002 |
| EP | 0859073 B1 | 11/2003 |
| WO | WO 90/01521 | 2/1990 |
| WO | WO 94/28219 | 12/1994 |
| WO | WO 99/10580 | 3/1999 |
| WO | WO 00/08243 | 2/2000 |
| WO | WO 01/49908 | 7/2001 |
| WO | WO 03/040442 | 5/2003 |
| WO | WO 04/067818 | 8/2004 |

OTHER PUBLICATIONS

ASTM Designation: D 1238-01, "Standard Test Method for Melt Flow Rates of Thermoplastics by Extrusion Plastometer," Published Oct. 2001, pp. 1-12.

ASTM Designation: D4703-03, "Standard Practice for Compression Molding Thermoplastic Materials into Test Specimens, Plaques, or Sheets," Published Sep. 2003, pp. 1-12.

ASTM Designation: D792-00, "Standard Test Methods for Density and Specific Gravity (Relative Density) of Plastics by Displacement," Published Mar. 2001, pp. 1-6.

ASTM Designation: D3108-01, "Standard Test Method for Coefficient of Friction, Yarn to Solid Material," Published Nov. 2001, pp. 1-6.

Bigg, D.M., "Effect of Copolymer Ratio on the Crystallinity and Properties of Polylactic Acid Copolymers", *ANTEC '96*, 1996, pp. 2028-2039.

Gallagher, P.K., "Differential Thermal Analysis and Differential Scanning Calorimetry," Chapter 1, Section IV, *Thermal Characterization of Polymeric Materials*, Second Edition, vol. 1, Academic Press, 1981, pp. 73-102.

Wilchinsky, Z.W., "On Crystal Orientation in Polycrystalline Materials," *Journal of Applied Physics*, vol. 30, No. 1, Jan. 1959, p. 792.

Patent Abstracts of Japan, JP 09291454, Nov. 11, 1997, KAO Corp.

* cited by examiner

EXTENSIBLE AND ELASTIC CONJUGATE FIBERS AND WEBS HAVING A NONTACKY FEEL

This application claims priority to U.S. Provisional Application No. 60/554,482, entitled "EXTENSIBLE AND ELASTIC CONJUGATE FIBERS AND WEBS HAVING A NONTACKY FEEL" and filed on Mar. 19, 2004, in the names of Joy F. Jordan et al.

FIELD OF THE INVENTION

Attention is drawn to a related application entitled "Propylene-Based Copolymers, a Method of Making the Fibers and Articles Made from the Fibers" in the names of Chang et al., Ser. No. 60/554,664 which is incorporated herein by reference in its entirety.

The invention concerns fibers and webs formed from olefin polymers and having extensible and/or elastic properties without the tacky feel associated with previously produced elastic fibers and webs. Such fibers and filaments find applications in many diverse products such as personal care products like disposable diapers, swim pants, incontinent wear, feminine hygiene products, veterinary products, bandages, as well as items of health care such as surgeon's gowns, surgical drapes, sterilization wrap and the like, and home furnishing such as bedding, wipes, and the like.

BACKGROUND

The manufacture of low cost fibers and webs has become a well developed industry making possible many innovative products such as disposable diapers, child swim pants, child training pants, and adult incontinent wear, just to name a few. As these products evolve and improvements are made, the requirements of the fiber and web components have also changed placing ever increasing demands on these materials. In particular, elastic properties are sought for improved comfort and fit as waistbands, leg cuffs, and even overall backing or absorbent components of such products as well as others like surgeon's gown cuffs and the like. Traditional rubber and other textile elastic materials have found only limited use for these applications due to cost and difficulties in processing on high speed equipment used for manufacturing many of these disposable products.

Polymer manufacturers have made available new classes of olefin polymers that are melt-processable in much the same manner as traditional polyolefins but have elastic properties approaching those of traditional rubber and textile elastic and that can be cost effective for disposable fiber and web applications such as those previously described. Acceptance of these olefin polymers for many applications has been retarded, however, due to a tacky and uncomfortable feel that makes the fibers and webs undesirable for skin contact uses.

There is, therefore, a need for elastic fibers and webs that take advantage of low cost olefin polymers which do not have the associated tacky feel. This invention provides such fibers and webs of olefin polymers in conjugate fiber form as further described in detail below.

SUMMARY OF THE INVENTION

The present invention provides for an extensible conjugate fiber having a total heat of melting of less than about 80 Joules per gram, preferably less than 70 Joules per gram, and more preferably less than 60 Joules per gram. The fiber comprises 0.001% to about 20% desirably to about 15% for some applications and to about 10% for other applications by weight of the total fiber, of a first component A which comprises at least a portion, in some cases at least a third, of the fiber surface, said first component comprising a polypropylene homopolymer or a propylene copolymer, and a second component B which comprises an elastic olefin polymer, which in some cases is a propylene-based olefin polymer. The invention further provides for an extensible conjugate fiber described above wherein at least 5% of the heat of melting occurs below 80° C., preferably at least 25%; even more preferably at least 40%. Embodiments include those where the conjugate fiber is in a sheath/core configuration, eccentric sheath/core configuration or other configuration such as hollow or pie segment arrangement. Advantageous results are obtained with sheath/core configurations where the sheath is discontinuous or fractured. In some embodiments, component A will constitute 90% or more of the fiber surface. Also, the fiber may be in continuous filament length or staple length form for various applications. Webs may be formed by spunbonding, meltblowing, carding, wetlaying, airlaying or using textile forming steps like knitting and weaving.

The invention may be practiced using a variety of low modulus polymers for component A, including relatively nonelastic, higher melting and more crystalline polymers as well as blends of polymers that separate into sheath patches or discontinuities. Typically, component B may be selected from elastic olefin polymers and copolymers including single site catalyzed or metallocene or non-metallocene catalyzed ethylene and propylene based polymers such as a reactor grade polymer having a MWD less than about 5 and blends, and in many cases will have a heat of melting less than about 60 Joules per gram. Both components A and B may contain various additives for specific properties, and additional components may be included as explained in more detail below. Moreover, certain embodiments will utilize olefin copolymers for components A and B with at least about 2% by weight less co-monomer in component A. Other embodiments use as component A or B a propylene alpha olefin copolymer containing at least 9% by weight of comonomer.

Fibers and webs may also be treated by known techniques such as crimping, creping, laminating and coating, printing or impregnating with agents to obtain properties such as repellency, wettability, or absorbency as desired. The invention also includes disposable and other product applications for these elastic fibers and webs.

Different embodiments include sheath/core configurations where the sheath forms ripples, fractures or patches and/or is discontinuous. In one embodiment the sheath may include a blend of phase separated polymers forming patches.

Webs in accordance with the invention may be formed by melt extrusion pneumatically drawn processes like spunbond and meltblown and have first set cycle at 80% strain properties of less than about 40% and for some applications less than about 15%. The invention also includes a method for forming such fibers and webs.

DESCRIPTION

Figure 1:
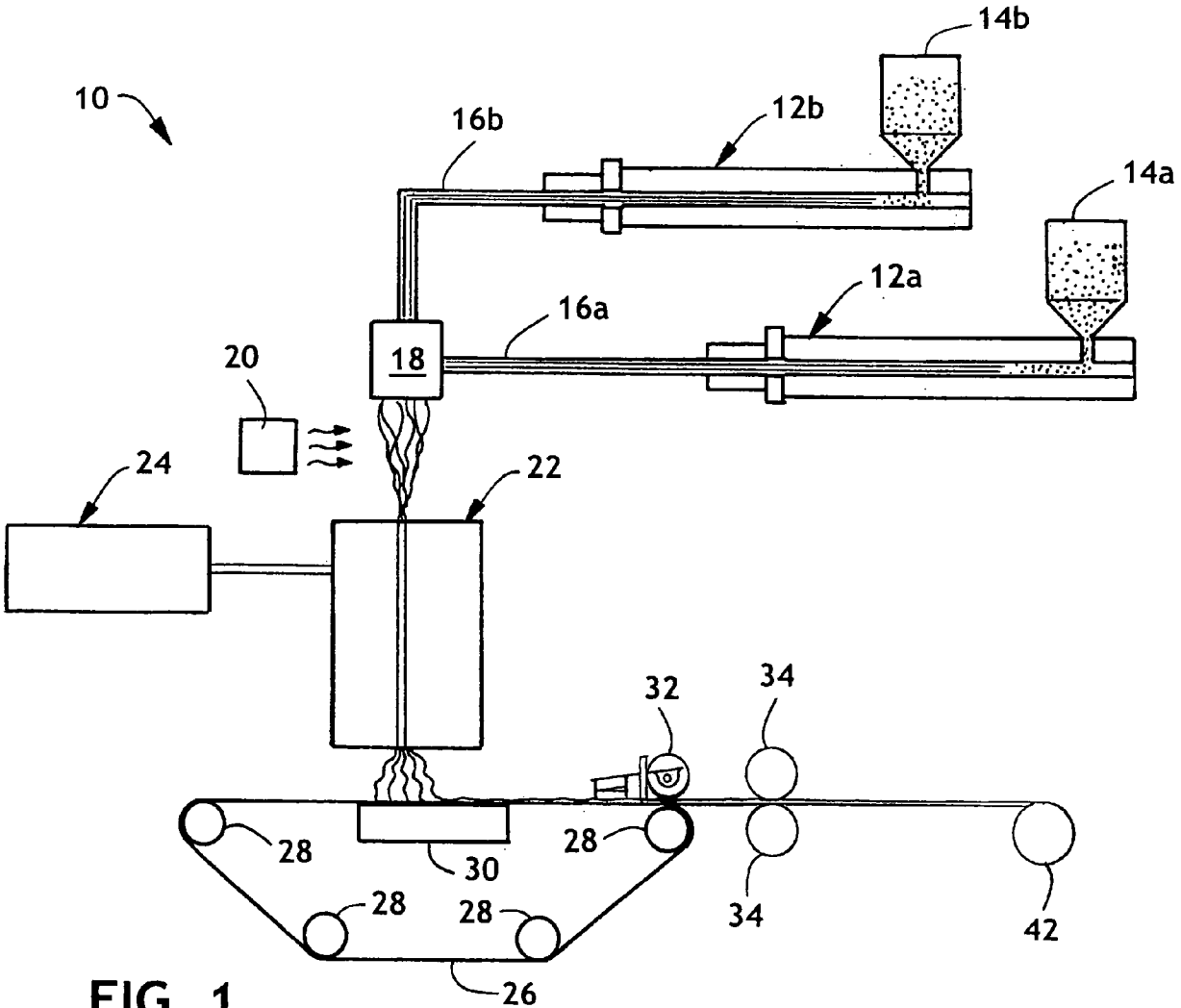
FIG. 1 is a schematic illustration of a bicomponent spinning system that may be used in accordance with the invention to form a spunbond nonwoven.

While the invention will be described in connection with specific embodiments including the best mode, it will be understood that it is not limited to the described embodiments which are for illustration purposes. On the contrary, the invention is intended to embrace all alternatives, modifications and equivalents as may be included within the spirit and scope of the invention as defined by the appended claims.

Test Procedures

Melt Flow Rate:

In order to determine the melt flow rate of the polymers, ASTM D1238 test method was used. Polymers with propylene were measured using the polypropylene condition of 230° C. and 2.16 kg. The ethylene-octene polymer was measured with the polyethylene condition of 190° C. and 2.16 kg.

Setting the Sheath and Core Content:

In order to set the sheath content per fiber the following procedure was used. The ratio of the sheath component mass flow rate to the total mass flow rate of polymer to the spinplate is the sheath percentage. Therefore the sheath content is the mass percent of sheath polymer in the fiber.

Density Method:

Coupon samples (1 inch×1 inch×0.125 inch) were compression molded at 190° C. according to ASTM D4703-00 and cooled using procedure B. Once the sample cooled to 40–50° C., it was removed. Once the sample reached 23° C., its dry weight and weight in isopropanol was measured using an Ohaus AP210 balance (Ohaus Corporation, Pine Brook, N.J.). Density was calculated as prescribed by ASTM D792 procedure B.

DSC Method:

Differential scanning calorimetry (DSC) is a common technique that can be used to examine the melting and crystallization of semi-crystalline polymers. General principles of DSC measurements and applications of DSC to studying semi-crystalline polymers are described in standard texts (e.g., E. A. Turi, ed., *Thermal Characterization of Polymeric Materials*, Academic Press, 1981). Certain of the copolymers used in the practice of this invention are characterized by a DSC curve with a $T_{me}$ that remains essentially the same and a $T_{max}$ that decreases as the amount of unsaturated comonomer in the copolymer is increased. $T_{me}$ means the temperature at which the melting ends. $T_{max}$ means the peak melting temperature.

Differential Scanning Calorimetry (DSC) analysis is determined using a model Q1000 DSC from TA Instruments, Inc. Calibration of the DSC is done as follows. First, a baseline is obtained by running the DSC from −90° C. to 290° C. without any sample in the aluminum DSC pan. Then 7 milligrams of a fresh indium sample is analyzed by heating the sample to 180° C., cooling the sample to 140° C. at a cooling rate of 10° C./min followed by keeping the sample isothermally at 140° C. for 1 minute, followed by heating the sample from 140° C. to 180° C. at a heating rate of 10° C./min. The heat of fusion and the onset of melting of the indium sample are determined and checked to be within 0.5° C. from 156.6° C. for the onset of melting and within 0.5 J/g from 28.71 J/g for the heat of fusion. Then deionized water is analyzed by cooling a small drop of fresh sample in the DSC pan from 25° C. to −30° C. at a cooling rate of 10° C./min. The sample is kept isothermally at −30° C. for 2 minutes and heated to 60° C. at a heating rate of 10° C./min. The onset of melting is determined and checked to be within 0.5° C. from 0° C.

Figure 4:
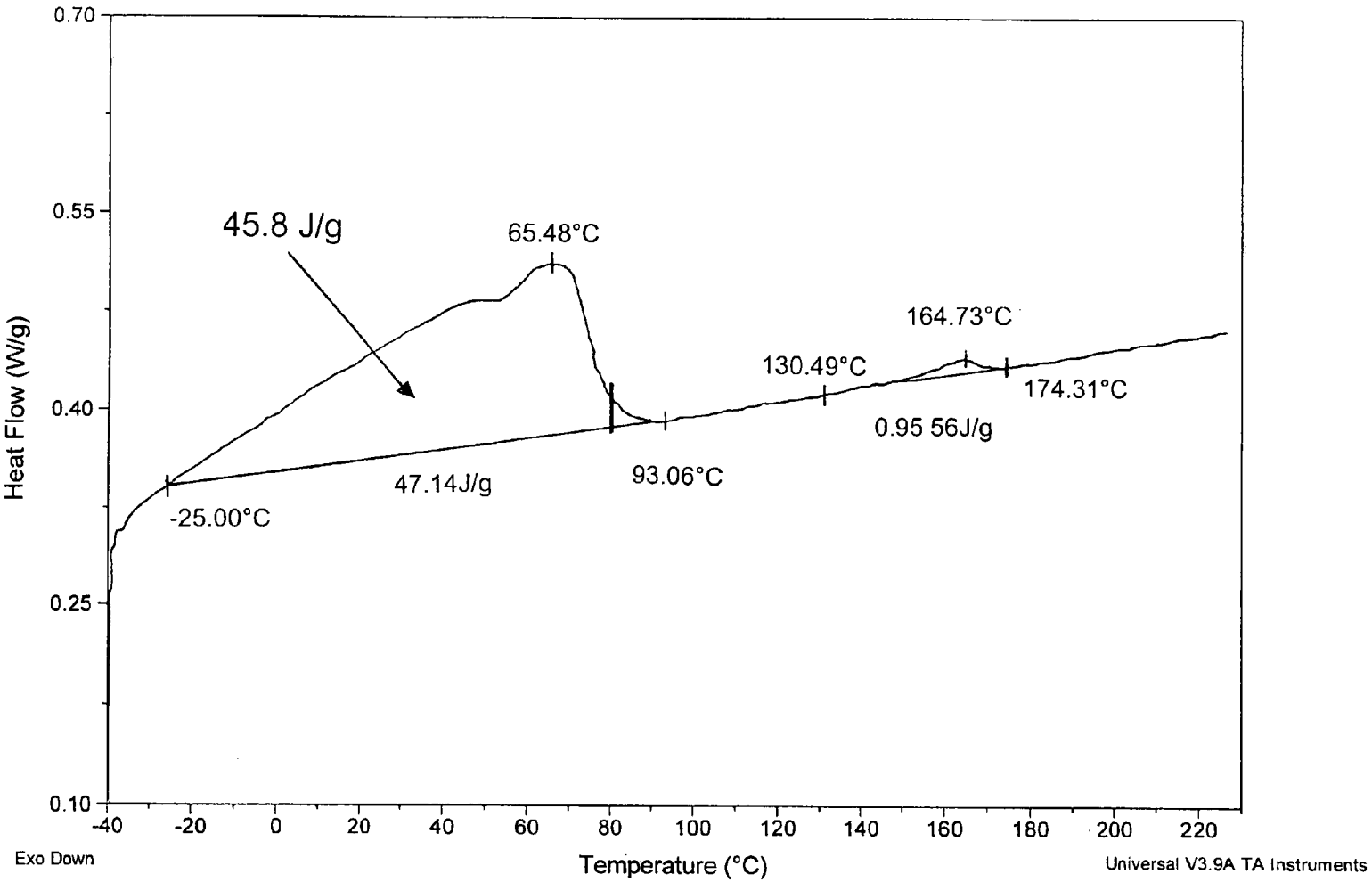
FIG. 4 is the $2^{nd}$ heating DSC thermogram of Example 1-01.

The polymer samples are pressed into a thin film at a temperature of 190° C. About 5 to 8 mg of sample is weighed out and placed in the DSC pan. The lid is crimped on the pan to ensure a closed atmosphere. The sample pan is placed in the DSC cell and heated at a high rate of about 100° C./min to a temperature of about 30° C. above the melt temperature. The sample is kept at this temperature for about 3 minutes. Then the sample is cooled at a rate of 10° C./min to −40° C., and kept isothermally at that temperature for 3 minutes. Consequently the sample is heated at a rate of 10° C./min until complete melting. This step is designated as the $2^{nd}$ heating. The resulting enthalpy curves are analyzed for peak melt temperature, onset and peak crystallization temperatures, total heat of fusion (also known as heat of melting) (ΔH), the heat of fusion (melting) below 80° C. ($\Delta H_{PA}$ (80° C.). The total heat of fusion was measured by integrating the area under the melting endotherm from the beginning of melting to the end of melting by using a linear baseline. The heat of fusion (melting) below 80° C. was defined as the partial area of the total heat of fusion below 80° C. This is typically measured by dropping a perpendicular at 80° C. using standard DSC software. FIG. 4 illustrates this calculation for Example 1-01.

DSC Method for Fibers and Fabric:

The equipment, calibration procedures, sample preparation, and data analysis were similar to the description in the previous section. The difference was that fiber or fabric samples were used instead of film.

Fiber Tensile Test:

A tow of 144 filaments was loaded between two pneumatically activated line-contact grips separated by 2 inches. This is taken to be the gauge length. The flat grip facing is coated with rubber. Pressure is adjusted to prevent slippage (usually 50–100 psi). The crosshead is increased at 10 inches per minute until the specimen breaks. Strain is calculated by dividing crosshead displacement by 2 inches and multiplying by 100. Reduced load (g/denier) equals [load (grams force)/number of filaments/denier per filament]. Elongation was defined according to equation 1:

$$\text{Elongation}(\%) = \frac{L_{break} - L_o}{L_o} \times 100\% \qquad \text{Equation 1}$$

such that $L_o$ is the initial length and $L_{break}$ is the length at break. $L_o$ is taken as 2 inches. Tenacity is defined according to the equation 2:

$$\text{Tenacity}(g/den) = \frac{F_{break}(g)}{d \times f} \qquad \text{Equation 2}$$

such that $F_{break}$ is the force at break measured in grams force, d is denier per filament and f is the number of filaments.

Fiber 50% 1-Cycle Test:

The sample was loaded and the grip spacing was set up as done in the tensile test. The crosshead speed was set at 10 inches per minute. The crosshead was extended to 100% strain and returned to 0% strain at the same crosshead speed. After returning to 0% strain, the crosshead was extended at 10 inches per minute. The strain corresponding to the onset of load was taken as the set. Reduced load was measured during the first extension and first retraction of the crosshead at 30% strain. The retained load was calculated as the reduced load at 30% strain during retraction divided by the reduced load at 30% strain during extension.

Fabric Tensile Properties:

Specimens for nonwoven measurements were obtained by cutting 3 inch wide by 8 inch long strips from the web in the machine (MD) and cross direction (CD). Basis weight, in $g/m^2$, was determined for each sample by dividing the weight, measured with an analytical balance, divided by the area. A Sintech mechanical testing device fitted with pneumatically activated line-contact grips was used for fabric tensile testing. Initial grip separation was set to be 3 inches. Samples were gripped with the 8 inch length oriented parallel to the direction of crosshead displacement and then pulled to break at 12 inches/min. Peak load and peak strain were recorded for each tensile measurement.

Fabric Elasticity:

Elasticity was measured using a 1-cycle hysteresis test to 80% strain. In this test, samples were loaded into a Sintech mechanical testing device fitted with pneumatically activated line-contact grips with an initial separation of 4 inches. Then the sample was stretched to 80% strain at 500 mm/min, and returned to 0% strain at the same speed. The strain at 10 g load upon retraction was taken as the set. The hysteresis loss is defined as the energy difference between the extension and retraction cycle. The load down was the retractive force at 50% strain. In all cases, the samples were measured green or unaged.

Feel of Fiber:

The feel of the fiber is measured by the coefficient of friction to a 0.25 inch diameter steel rod (Rockwell hardness C60–C62; smoothness max of 10 microinch) with a 90° C. wrap angle according to ASTM D3108. Samples were comprised of 144 filaments. The test speed was 20 meters per minute and the pretension was 5 grams force.

Feel of Nonwoven:

The feel of the nonwoven web is characterized by the coefficient of friction determined when sliding fabric across fabric for six inches (152 mm) at 152 mm/min. To carry out the test, a sled having dimensions of 2 inches by 4 inches (50.8 mm by 101.6 mm) with added foam to obtain a final weight of 200 g, has attached by eye screws to its bottom surface, a sample of the test material of 120 mm long (MD) and 67 mm wide (CD). A second sample of the test material is attached to a flat surface covering at least the sled travel space and having a width of 305 mm (MD) and about 102 mm to 127 mm (CD). A 25.4 mm V-cut may be made in the sled sample for fit around the eye screw if used. The sled is positioned on the fabric covered test surface and connected to a device such as a Chatillion Model DFI COF-2 averaging gauge for 200 g sled available from S. A. Meyer, Milwaukee, Wis. by a fully extended wire with the MD of the specimens parallel to the wire. The sled travel may be controlled by a device such as a Kayeness "Combi" Model 1055 tester available from Kayeness, Inc., Honey Brook, Pa., and the gauge provides continuous readings for the 60 seconds of travel, and the mean COF and peak COF are determined. Tests were carried out under standard conditions of about 23° C. and 50% RH. Ten repetitions were made and results averaged. Samples were prepared of 3 ply thickness with the outer plies of both the table and sled samples removed prior to starting the test. A higher coefficient of friction indicates a rougher or less desirable "feel" for the fabric. In general a coefficient of less than about 1.6 is acceptable and less than about 1.4 is desirable.

Scanning Electron Microscopy:

Fiber and nonwoven samples for scanning electron microscopy were mounted on aluminum sample stages with carbon black filled tape and copper tape. The mounted samples were then coated with 100–200 Å of gold-palladium using a SPI-Module Sputter Coater (Model Number 11430) from Structure Probe Incorporated (West Chester, Mass.) fitted with an argon gas supply and a vacuum pump.

The coated samples were then examined in an S4100 scanning electron microscope equipped with a field effect gun and supplied by Hitachi America, Ltd (Shaumberg, Ill.). Samples were examined using secondary electron imaging mode using an acceleration voltage of 3–5 kV and images were collected using a digital image capturing system.

Definitions

As used herein, the following terms have the specified meanings, unless the context demands a different meaning, or a different meaning is expressed; also, the singular generally includes the plural, and the plural generally includes the singular unless otherwise indicated.

As used herein the term "comprising" is open and includes the addition or combination of other compositional components, apparatus elements or method steps that do not defeat the operation and results of the invention.

As used herein, the term "fiber" is generic to elements having an elongated configuration that may be of a defined length or continuous.

As used herein, the term "filament" is a species of the term "fiber" and means a melt extruded and pneumatically drawn, generally continuous strand that has a very large ratio of length to diameter, for example, a thousand or more.

As used herein, the term "extensible" includes materials that may or may not have retractive properties but are stretchable to at least 50% (i.e. 1.5×) of the original dimension for fiber and to at least 100% (i.e. 2×) of the original dimension for fabric using the respective Tensile Test procedures described herein. "Elastic" web means that a web sample will have a set of less than 40% as measured by the 1-cycle test to 80% strain described above under Test Procedures. "Elastic" fiber means that a fiber sample will have a set of less than 15% as measured by the 1-cycle test to 50% strain described under Test Procedures.

As is known, reduced levels of set indicate higher levels of elastic properties and, for some applications, fibers and webs of the invention will have set values less than 15%, for example. A fiber or web is stretched to a certain point and subsequently released to the original position before stretch, and then stretched again. The point at which the fiber or web begins to pull a load is designated as the percent set and in terms of the number of stretch cycles used. "Elastic materials" are also referred to in the art as "elastomers" and "elastomeric". Elastic material (sometimes referred to as an elastic article) includes the polymer itself as well as, but not limited to, the polymer in the form of a fiber, film, strip, tape, ribbon, sheet, and the like. The preferred elastic material is a web. The elastic material can be either cured or uncured, radiated or non-radiated, and/or crosslinked or non-crosslinked.

As used herein, the term "nonelastic" means a material not meeting the definition of "elastic" and may be extensible or non-extensible.

As used herein, the term "nonwoven" means a web of fibers or filaments that is formed by means other than knitting or weaving and that contains bonds between some or all of the fibers or filaments; such bonds may be formed, for example, by thermal, adhesive or mechanical means such as entanglement. Common nonwovens are formed by spunbond, meltblown, carding, wetlaying and airlaying processes.

As used herein, the term "spunbond" means a nonwoven of filaments formed by melt extrusion of a polymer extrudate into strands that are quenched and drawn, usually by high velocity air, to strengthen the filaments which are collected on a forming surface and bonded, often by the patterned application of heat and pressure. Spunbonded processes are described, for example, in the following patents which are incorporated herein by reference, each in its entirety: U.S. Pat. No. 4,340,563 to Appel et al., U.S. Pat. No. 3,802,817 to Matsuki et al. and U.S. Pat. No. 3,692,618 to Dorschner et al.

As used herein, the term "meltblown" means a nonwoven formed by extruding a molten polymer extrudate through a plurality of fine, usually circular, die capillaries as molten threads or filaments into converging high velocity, usually heated, gas (e.g. air) streams which attenuate the filaments, reducing their diameter, usually to microfiber (i.e. less than 10 microns diameter) size. The filaments are carried by the high velocity gas stream and deposited on a collecting surface, often while still tacky, to form a web of randomly dispersed, generally continuous, filaments. Such a process is described, for example, in U.S. Pat. No. 3,849,241 to Buntin, incorporated herein by reference in its entirety.

As used herein, the terms "conjugate" and "multicomponent" are used interchangeably and mean fibers or filaments that are formed by combining multiple extrudates in each fiber or filament resulting in at least two distinct sections occupied by separate polymer components along the entire length of the fiber or filament. The cross section of the fiber may take many different configurations, such as side-by-side, pie, sheath-core, eccentric sheath-core and islands-in-the-sea. Of particular interest to the present invention are sheath-core configurations. Conjugate fibers or filaments may also have one or more hollow portions for some applications. Conjugate fibers and filaments as well as their preparation are described, for example, in U.S. Pat. No. 5,425,987 to Shawver et al., incorporated herein by reference in its entirety. Conjugate fibers and filaments may be formed by processes including, but not limited to, spunbond and meltblown processes.

"Polymer" means a macromolecular compound prepared by polymerizing monomers of the same or different type. "Polymer" includes homopolymers, copolymers, terpolymers, interpolymers, and so on. The term "interpolymer" means a polymer prepared by the polymerization of at least two types of monomers or comonomers. It includes, but is not limited to, copolymers (which usually refers to polymers prepared from two different types of monomers or comonomers, although it is often used interchangeably with "interpolymer" to refer to polymers made from three or more different types of monomers or comonomers), terpolymers (which usually refers to polymers prepared from three different types of monomers or comonomers), tetrapolymers (which usually refers to polymers prepared from four different types of monomers or comonomers), and the like. The terms "monomer" or "comonomer" are used interchangeably, and they refer to any compound with a polymerizable moiety which is added to a reactor in order to produce a polymer. In those instances in which a polymer is described as comprising one or more monomers, e.g., a polymer comprising propylene and ethylene, the polymer, of course, comprises units derived from the monomers, e.g., $—CH_2—CH_2—$, and not the monomer itself, e.g., $CH_2{=}CH_2$. As used herein, the term "polymer" generally includes but is not limited to homopolymers, copolymers, such as for example, block, graft, random and alternating copolymers, terpolymers, etc. and blends and modifications thereof. Furthermore, unless otherwise specifically limited, the term includes all possible geometrical configurations of the molecular formula.

"P/E* copolymer" and similar terms mean a propylene/unsaturated comonomer (typically and preferably ethylene) copolymer characterized as having at least one of the following properties: (i) $^{13}C$ NMR peaks corresponding to a regio-error at about 14.6 and about 15.7 ppm, the peaks of about equal intensity, (ii) a DSC curve with a $T_{me}$ that remains essentially the same and a $T_{max}$ that decreases as the amount of comonomer, i.e., the units derived from ethylene and/or the unsaturated comonomer(s), in the copolymer is increased, and (iii) an X-ray diffraction pattern that reports more gamma-form crystals than a comparable copolymer prepared with a Ziegler-Natta (Z-N) catalyst. Typically the copolymers of this embodiment are characterized by at least two, preferably all three, of these properties. In other embodiments of this invention, these copolymers are characterized further as also having the following characteristics: (iv) a skewness index, $S_{ix}$, greater than about −1.20.

As used herein, "propylene-based olefin polymer" means a polymer or copolymer that is exclusively or predominantly made up of propylene units.

"Metallocene-catalyzed polymer" or similar term means any polymer that is made in the presence of a metallocene catalyst. "Constrained geometry catalyst catalyzed polymer", "CGC-catalyzed polymer" or similar term means any polymer that is made in the presence of a constrained geometry catalyst. "Ziegler-Natta-catalyzed polymer", Z-N-catalyzed polymer" or similar term means any polymer that is made in the presence of a Ziegler-Natta catalyst. "Metallocene" means a metal-containing compound having at least one substituted or unsubstituted cyclopentadienyl group bound to the metal. "Constrained geometry catalyst" or "CGC" as here used has the same meaning as this term is defined and described in U.S. Pat. Nos. 5,272,236 and 5,278,272.

"Random copolymer" means a copolymer in which the monomer is randomly distributed across the polymer chain. "Propylene homopolymer" and similar terms mean a polymer consisting solely or essentially all of units derived from propylene. "Polypropylene copolymer" and similar terms mean a polymer comprising units derived from propylene and ethylene and/or one or more unsaturated comonomers. The term "copolymer" includes terpolymers, tetrapolymers, etc.

The component B polymers of this invention, either alone or in combination with one or more other polymers may be blended, if desired or necessary, with various additives such as antioxidants, ultraviolet absorbing agents, antistatic agents, nucleating agents, lubricants, flame retardants, anti-blocking agents, colorants, inorganic or organic fillers or the like. These additives are used in a conventional matter and in conventional amounts.

While the component B for the fibers of this invention can comprise a blend of the propylene copolymers used in the practice of this invention with one or more other polymers, and the polymer blend ratio can vary widely and to convenience, in one embodiment of this invention the fibers comprise a component B blend with at least about 98, preferably at least about 99 and more preferably essentially 100, weight percent of a propylene copolymer comprising at least about 50, preferably at least about 60 and more preferably at least about 70, weight percent of units derived from propylene and at least about 8 weight percent of units derived from a comonomer other than propylene (preferably ethylene or a $C_{4-12}$ α-olefin), the copolymer characterized as having a heat of melting of 60 Joules per gram or less, preferably 50 Joules per gram or less, and more preferably 40 Joules per gram or less. In another embodiment of the invention, the propylene copolymer is one or more propylene/ethylene copolymers. As noted earlier, fibers made from these polymers or polymer blends can take any one of a number of different forms and configurations.

In accordance with the invention, conjugate fibers or filaments are formed with a component A that comprises at least a portion and, in some embodiments, 90% or more of the fiber or filament surface as formed. The surface content may be readily determined from the extrusion rates, especially for a sheath-core fiber or filament configuration where component A is the sheath component. It is also important that the sheath component content not exceed about 10% by weight to avoid deleterious effects on elastic properties. To obtain a discontinuous sheath it is desirable that the sheath component not exceed about 6% by weight.

In accordance with the invention, component A is desirably selected from polymers and copolymers that may be metallocene catalyzed or non-metallocene catalyzed ethylene or propylene based elastomers and plastomers. Examples include, but are not limited to, propylene based elastomers and plastomers available from Dow and as VISTAMAXX brand from Exxon-Mobil and TAFMER brand from Mitsui. Co-monomers can include C2, C4–C22 as well as others like diene, 4-methyl pentene for functional advantages. Selection of propylene copolymers having about 93 mole % to essentially 100 mole % propylene, in general, and about 90 mole % to essentially 100 mole % propylene for ethylene copolymers, in particular. Higher mole % propylene tends to produce stiffer fibers and filaments while higher mole % comonomer, for example, tends to increase elasticity. For certain embodiments, component A may be a blend of phase separated polymers providing a unique skin configuration of patches of the phase separated polymers.

In accordance with the invention, component B is desirably selected from elastic polymers and copolymers that may be metallocene catalyzed or non-metallocene catalyzed ethylene or propylene based elastomers. The microstructure may be random, nonrandom or block copolymers, for example. Examples include, but are not limited to, propylene based elastomers and plastomers available as, for example, AFFINITY brand and others from Dow and as VISTAMAXX or Exact brands from Exxon-Mobil, and TAFMER brand from Mitsui. For propylene based copolymers, co-monomers can be $C_2$, $C_4$–$C_{22}$ as well as others like diene, 4-methyl pentene for functional advantages. Selection of co-monomer amount will be based on the particular co-monomer and the desired elastic properties with reduced amounts resulting in increased elasticity and lower crystallinity. For propylene based copolymers, in general, the weight % of propylene is desirably in the range of from about 60 to 91% and the mole % of propylene is desirably in the range of from about 79 to 91 mole %. For copolymers with ethylene, in particular, the weight % of propylene is desirably in the range of from about 84 to 91% and the mole % is desirably in the range of from about 77 to 87 mole %. For ethylene based elastomers, selection desirably is based on a crystallinity range of from about 1 to 39% by volume, with about 1 to 15% by volume advantageous for some applications. Volume percent crystallinity is calculated using the 2-phase model defined as $$\frac{1}{\rho} = \frac{x}{\rho_c} + \frac{1-x}{\rho_a}$$

such that ρ is the density of the polymer, $\rho_c$ is the crystalline density, $\rho_a$ is the amorphous density, and x is the weight fraction of crystals. The quotient $x/\rho_c$ multiplied by 100% is taken as the volume percent crystallinity. In the case of propylene crystallinity, $\rho_a$ is taken as 0.853 g/cm$^3$ and $\rho_c$ is taken as 0.936 g/cm$^3$.

For ethylene-octene elastomers, density ranges may be selected desirably within about 0.855 to 0.910 g/cc with about 0.855 to 0.875 advantageous for some applications. Other parameters such as melt flow and molecular weight distribution may be selected based on spinning conditions as will be known to those skilled in the art.

The component B propylene copolymers of this invention comprises at least about 50, preferably at least about 60 and more preferably at least about 70, wt % of units derived from propylene based on the weight of the copolymer. Sufficient units derived from propylene are present in the copolymer to ensure the benefits of propylene strain-induced crystallization behavior during melt spinning. Strain-induced crystallinity generated during draw facilitates spinning, reduce fiber breaks and roping.

Sufficient levels of co-monomer other than propylene control the crystallization such that elastic performance is maintained. Although the remaining units of the propylene copolymer are derived from at least one co-monomer such as ethylene, a $C_{4-20}$ α-olefin, a $C_{4-20}$ diene, a styrenic compound and the like, preferably the co-monomer is at least one of ethylene and a $C_{4-12}$ α-olefin such as 1-hexene or 1-octene. Preferably, the remaining units of the copolymer are derived only from ethylene.

The amount of comonomer other than ethylene in the copolymer is a function of, at least in part, the comonomer and the desired heat of melting of the copolymer. The desired heat of melting of the copolymer does not exceed about 60 Joules per gram and for elastic fibers, it does not exceed about 50 Joules per gram. If the comonomer is ethylene, then typically the comonomer-derived units comprise not in excess of about 16, preferably not in excess of about 15 and more preferably not in excess of about 12, wt % of the copolymer. The minimum amount of ethylene-derived units is typically at least about 5, preferable at least about 6 and more preferably at least about 8, wt % based upon the weight of the copolymer.

The component B propylene copolymers of this invention can be made by any process, and include copolymers made by Zeigler-Natta, CGC, metallocene, and nonmetallocene, metal-centered, heteroaryl ligand catalysis. These copolymers include random, block and graft copolymers although preferably the copolymers are of a random configuration. Exemplary propylene copolymers include Exxon-Mobil VISTAMAXX, Mitsui TAFMER and propylene-based elastomers and plastomers by The Dow Chemical Company.

The density of the component B copolymers of this invention is typically at least about 0.850, preferably at least about 0.860 and more preferably at least about 0.865, grams per cubic centimeter ($g/cm^3$). Typically the maximum density of the propylene copolymer is about 0.915, preferably the maximum is about 0.900 and more preferably the maximum is about 0.890, $g/cm^3$.

The weight average molecular weight (Mw) of the component B copolymers of this invention can vary widely, but typically it is between about 10,000 and 1,000,000 (with the understanding that the only limit on the minimum or the maximum Mw is that set by practical considerations). For copolymers used in the manufacture of meltblown fibers, preferably the minimum Mw is about 20,000, more preferably about 25,000.

The polydispersity of the component B copolymers of this invention is typically between about 2 and about 4. "Narrow polydispersity", "narrow molecular weight distribution", "narrow MWD" and similar terms mean a ratio ($M_w/M_n$) of weight average molecular weight ($M_w$) to number average molecular weight ($M_n$) of less than about 3.5, preferably less than about 3.0, more preferably less than about 2.8, more preferably less than about 2.5, and most preferably less than about 2.3. Polymers for use in fiber applications typically have a narrow polydispersity. Blends comprising two or more of the copolymers of this invention, or blends comprising at least one copolymer of this invention and at least one other polymer, may have a polydispersity greater than 4 although for spinning considerations, the polydispersity of such blends is still preferably between about 2 and about 4.

Examples of suitable component B polymers are described in greater detail in U.S. patent application Ser. No. 60/554,664 filed on even priority date herewith in the names of Chang et. al. and entitled "Propylene-Based Copolymers, a Method of Making the Fibers and Articles Made from the Fibers" which is incorporated herein by reference in its entirety.

Component B may also be comprised of a blend of at least one propylene-copolymer such as propylene-ethylene. Suitable additional polymers may include other propylene copolymers including but not limited to propylene-ethylene, homopolymer polypropylene, and polyethylenes. Also, ethylene polymers and copolymers may be employed. Suitable additional polymers may be made by Zeigler-Natta, CGC, metallocene, and nonmetallocene, metal-centered, heteroaryl ligand catalysis. These copolymers include random, block and graft copolymers although preferably the copolymers are of a random configuration. The component B blend may be made in-reactor, in a configuration of multiple reactors such as series, in a side-arm extrusion process, or by melt blending.

Turning to FIG. 1, a process line 10 for preparing one embodiment of the present invention is illustrated. The process line 10 is arranged to produce bicomponent continuous filaments but it should be understood that the present invention comprehends nonwoven fabrics made with conjugate filaments having more than two components. For example, the filaments and nonwoven fabrics of the present invention can be made with filaments having three, four or more components.

The process line 10 includes a pair of extruders 12*a* and 12*b* for separately extruding a polymer component A and a polymer component B. Polymer component A is fed into the respective extruder 12*a* from a first hopper 14*a* and a polymer component B is fed into the respective extruder 12*b* from a second hopper 14*b*. Polymer components A and B are fed from the extruders 12*a* and 12*b* through respective polymer conduits 16*a* and 16*b* to a spinneret 18.

Spinnerets for extruding conjugate filaments are well-known to those of skill in the art and thus are not described herein in detail. Generally described, the spinneret 18 includes a housing containing a spin pack which includes a plurality of plates stacked one on top of the other with a pattern of openings arranged to create flow paths for directing polymer components A and B separately through the spinneret. The spinneret 18 has openings arranged in one or more rows. The spinneret openings form a downwardly extruding curtain of filaments when the polymers are extruded through the spinneret. Spinneret 18 may be arranged to form sheath/core, eccentric sheath/core or other filament cross-sections.

The process line 10 also includes a quench blower 20 positioned adjacent the curtain of filaments extending from the spinneret 18. Air from the quench air blower 20 quenches the filaments extending from the spinneret 18. The quench air can be directed from one side of the filament curtain as shown in FIG. 1 or both sides of the filament curtain.

A fiber draw unit or aspirator 22 is positioned below the spinneret 18 and receives the quenched filaments. Fiber draw units or aspirators for use in melt spinning polymers are well-known as discussed above. Suitable fiber draw units for use in the process of the present invention include a linear fiber aspirator of the type shown in U.S. Pat. Nos. 3,802,817 and 3,423,255, the disclosures of which are incorporated herein by reference in their entireties.

Generally described, the fiber draw unit 22 includes an elongate vertical passage through which the filaments are drawn by aspirating air entering from the sides of the passage and flowing downwardly through the passage. A heater or blower 24 supplies aspirating air to the fiber draw unit 22. The aspirating air draws the filaments and ambient air through the fiber draw unit.

An endless foraminous forming surface 26 is positioned below the fiber draw unit 22 and receives the continuous filaments from the outlet opening of the fiber draw unit. The forming surface 26 travels around guide rollers 28. A vacuum 30 positioned below the forming surface 26 where the filaments are deposited draws the filaments against the forming surface.

The process line 10 further includes a bonding apparatus such as thermal point bonding rollers 34 (shown in phantom) or a through-air bonder 36. Thermal point bonders and through-air bonders are well-known to those skilled in the art and are not described herein in detail. Generally described, the through-air bonder 36 includes a perforated roller 38 which receives the web, and a hood surrounding the perforated roller. Lastly, the process line 10 includes a winding roll 42 for taking up the finished fabric.

To operate the process line 10, the hoppers 14*a* and 14*b* are filled with the respective polymer components A and B. Polymer components A and B are melted and extruded by the respective extruders 12*a* and 12*b* through polymer conduits 16*a* and 16*b* and the spinneret 18. As the extruded filaments extend below the spinneret 18, a stream of air from the quench blower 20 at least partially quenches the filaments.

After quenching, the filaments are drawn into the vertical passage of the fiber draw unit 22 by a flow of a gas such as air, from the heater or blower 24 through the fiber draw unit. The flow of gas causes the filaments to draw or attenuate which increases the molecular orientation or crystallinity of the polymers forming the filaments.

The filaments are deposited through the outlet opening of the fiber draw unit 22 onto the traveling forming surface 26. The vacuum 30 draws the filaments against the forming surface 26 to consolidate an unbonded nonwoven web of continuous filaments. If necessary the web may be further compressed by a compression roller 32 and then thermal point bonded by rollers 34 or through air bonder 36.

In the through air bonder 36 as shown in FIG. 1, air having a temperature above the melting temperature of component B and equal to or below the melting temperature of component A is directed from the hood 40 through the web and into the perforated roller 38. The hot air melts the polymer component B and thereby forms bonds between the bicomponent filaments to integrate the web. When polypropylene and polyethylene are used as polymer components, the air flowing through the through air bonder preferably has a temperature ranging from about 230° to about 280° F. and a velocity from about 100 to about 500 feet per minute. The dwell time in the through air bonder is preferably less than about 6 seconds. It should be understood, however, that the parameters of the through air bonder depend on factors such as the type of polymers used and thickness of the web.

Lastly the finished web may be wound onto the winding roller 42 or directed to additional in line processing and/or converting steps (not shown) as will be understood by those skilled in the art.

Although the methods of bonding discussed with respect to FIG. 1 are thermal point bonding and through air bonding, it should be understood that the nonwoven fabric of the invention may be bonded by other means such as oven bonding, ultrasonic bonding, hydroentangling, needling, or combinations thereof. Such steps are known, and are not discussed herein in detail.

The formation of elastic conjugate meltblown fibers and filaments as well as webs is also contemplated in accordance with the invention. For a description of a meltblowing conjugate process, U.S. Pat. No. 6,461,133 to Lake et al., which is incorporated herein by reference in its entirety. Generally, a polymer distribution and spinning process similar to that described above may be used except that upon formation the filaments are contacted by converging streams of high velocity air preferably heated and blown onto the forming surface as a mat of tacky fibers. If desired, additional bonding steps as described above may be used.

Figure 2A:
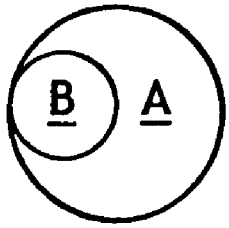
FIGS. 2A–2C illustrate various cross-sectional configurations of sheath/core structures for conjugate fibers in accordance with the invention.
Figure 2B:
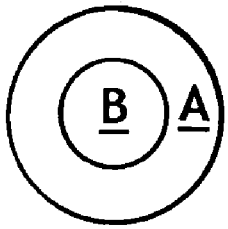
Figure 2C:
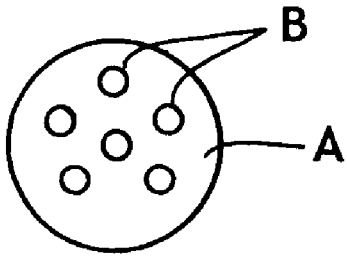

Turning to FIG. 2, there are illustrated in cross-section three forms of conjugate sheath/core fibers. FIG. 2A is an eccentric arrangement where core component B is off-center and may actually form a part of the outer fiber surface but is still primarily within the fiber cross-section. FIG. 2B is a standard sheath/core arrangement with the core component wholly within core component A and generally centrally located. FIG. 2C represents an islands-in-the-sea arrangement where there are multiple core components B within component A. Other arrangements will be apparent to those skilled in the art.

Figure 3C:
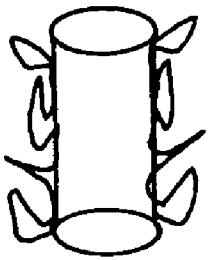
FIGS. 3A–3C are schematic illustrations showing fibers in accordance with the invention at different sheath configurations.
Figure 3B:
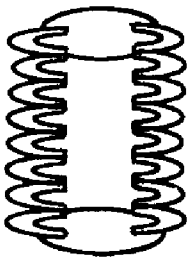
Figure 3A:
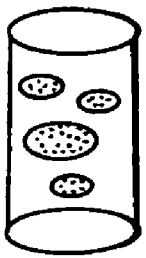

Turning to FIG. 3, there are illustrated in schematic perspective several types of sheath arrangements contemplated in accordance with the invention. FIG. 3A illustrates an arrangement where the sheath forms patches on the surface and may result from the use of a sheath component A that is a blend of incompatible polymers as described below. FIG. 3B illustrates a ripple or corrugated sheath forming a series of folds concentrically arranged around the fiber core component B. FIG. 3C illustrates a sheath forming discontinuous fragments along the surface of the fiber. Other arrangements will be apparent to those skilled in the art.

EXAMPLES

Polyolefin copolymers with DSC heats of melting less than about 60 J/g were used for Component B. Homopolymer and copolymers with more than about 60 J/g DSC heat of melting were used for Component A. The melt flow ratio (MFR) of each polymer was 20–40 (or about a 10–20 melt index (MI) equivalent).

TABLE 1

| Resin | Polymer Type | Description | MI or MFR | Density (g/cm$^3$) | ΔH (J/g) |
|---|---|---|---|---|---|
| PE1 | propylene-ethylene | 5 wt % ethylene | 25 MFR | 0.8887 | 71 |
| PE2 | propylene-ethylene | 9 wt % ethylene | 25 MFR | 0.876 | 54 |
| PE3 | propylene-ethylene | 12 wt % ethylene | 25 MFR | 0.867 | 34 |
| PE4 | propylene-ethylene | 15 wt % ethylene | 25 MFR | 0.860 | 18 |
| PP1 | homo-polymer PP | — | 38 MFR | 0.900 | 110 |
| RCP | random copolymer | 3 wt. % ethylene | 35 MFR | 0.90 | 89 |
| CR | ethylene-octene | 38–40 wt % octene | 10 MI | 0.870 | 50 |

Example 1

For this example a bicomponent spinline available from Hills of Melbourne, Fla. was used which consisted of two spinpumps, one used for component A operated at 2.5 cubic centimeters per revolution and the second for component B operated at 6.4 cubic centimeters per revolution. Component A was fed from an extruder with four zones maintained at temperatures of 170° C., 200° C., 220° C., and 220° C. Component B was fed from an extruder having four zones maintained at temperatures of 180° C., 210° C., 230° C., and 230° C. The die had 144 holes at 0.65 mm diameter and 3.85 L/D and was maintained at 230° C. The pressure set point at the extruders was 750 psi, and the fiber speed was 1350 meters/min starting from 800 meters/min and ramped up in 30 seconds. Fibers were drawn using a Godet roll at the indicated speed. Three quench zones were used at 12° C., upper air flow of 0.2 m/sec, middle air flow of 0.28 m/sec, and lower air flow of 0.44 m/sec. A sheath core configuration was spun at varying sheath content for examples 1-01 to 1-06 as indicated in Table 2 and using an ethylene-octene copolymer (30–40% by weight octene) having a MI of 10 and a density of 0.870 g/cc as the core, and polypropylene having a MFR of 38 and a density of 0.900 g/cc as the sheath. FIG. 4 illustrates the DSC properties described in Table 2. The thermogram shows that 99% of the enthalpy of melting of Example 1-01 occurs below 80 degrees Celsius and that the total enthalpy of melting (ΔH) is less than 50 J/g. Examples 1-07 to 1-10 describe sheath-core fibers made with PE1 and PE3. As references, comparative examples C1–C5 were included.

ponents that come in direct contact with skin is generally desirable as lower COF is an aspect of hand feel that translates to a "drier" and "cotton-like" feel rather than the "tacky", "sticky" or "wet" articles made with typical elastomers.

Figure 7:
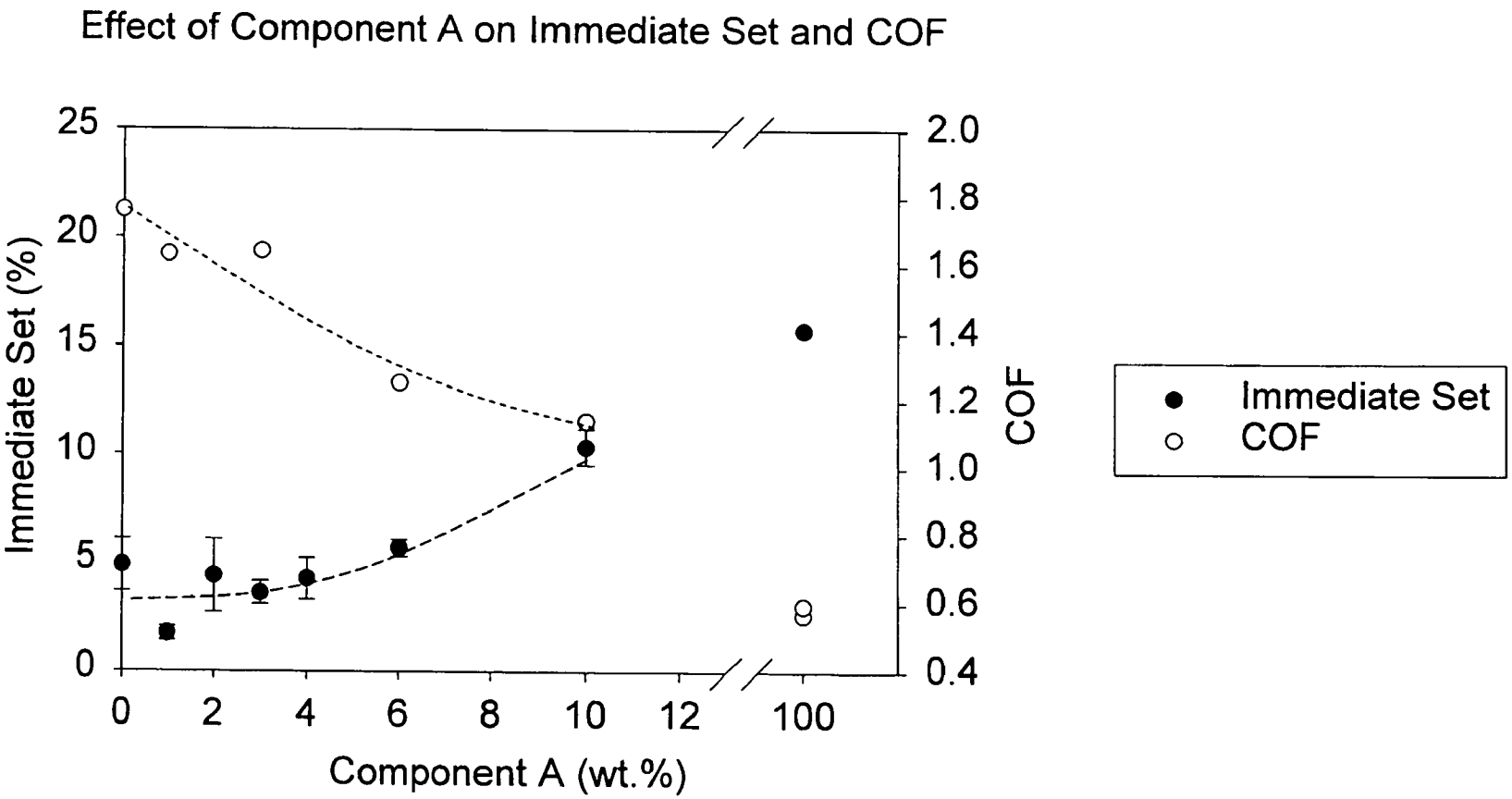
FIG. 7 is a graph plotting the COF and set for inventive conjugate fibers (examples 1-01 to 1-06) and comparative examples.

FIG. 7 illustrates elastic performance and COF as a function of sheath content for examples 1-01 to 1-06. As shown, decreasing sheath content below about 10% resulted in a reduced set and represents a desirable range from the perspective of elastic performance. Within 2–10 wt. % Component A, COF decreased as well. Com range for improved hand feel while maintaining a significant amount of elasticity. While the invention is not to be limited by any theory, it is believed that fibers with 2–10 wt. % component A have discontinuous sheath structure and this contributes to the desirable combination of relatively low COF and relatively low set.

The sheath structure as shown forms a partially corrugated or rippled structure and shares similar characteristics with the schematic shown in FIG. 3B. While not limited by any theory, the partially corrugated or rippled structure is thought to be a discontinuous sheath of component A. The corrugated regions of component A are thought to impart the desirable hand feel. The incomplete coverage of component A is thought to allow the more elastic component B to

TABLE 2

| Example | Core/ Sheath | Core | Sheath | Melt Temp (° C.) | Throughput (ghm) | Spinning Speed (m/min) | Denier per Filament (g/9000 m) | ΔH (J/g) | $\Delta H_{PA}$(80° C.) (%) | COF (fiber) |
|---|---|---|---|---|---|---|---|---|---|---|
| C1 | 100/0 | PP1 | — | 230 | 0.6 | 2000 | 2.90 | 104 | 2 | 0.57 |
| C2 | 100/0 | PP1 | — | 230 | 0.4 | 1350 | 2.47 | 103 | 2 | 0.59 |
| 1-01 | 99/1 | CR | PP1 | 230 | 0.4 | 1350 | 3.10 | 46 | 99 | 1.63 |
| 1-02 | 98/2 | CR | PP1 | 230 | 0.4 | 1350 | 2.96 | 46 | 97 | — |
| 1-03 | 97/3 | CR | PP1 | 230 | 0.4 | 1350 | 3.00 | 49 | 94 | 1.64 |
| 1-04 | 96/4 | CR | PP1 | 230 | 0.4 | 1350 | 2.61 | 50 | 92 | — |
| 1-05 | 94/6 | CR | PP1 | 230 | 0.4 | 1350 | 2.82 | 49 | 90 | 1.25 |
| 1-06 | 90/10 | CR | PP1 | 230 | 0.4 | 1350 | 2.68 | 54 | 80 | 1.14 |
| 1-07 | 90/10 | PE3 | PE1 | 220 | 0.6 | 1000 | 4.92 | 35 | 45 | — |
| 1-08 | 90/10 | PE3 | PE1 | 220 | 0.6 | 2000 | 3.01 | 36 | 46 | 0.98 |
| 1-09 | 90/10 | PE3 | PE1 | 220 | 0.3 | 2000 | 1.45 | 33 | 45 | — |
| 1-10 | 90/10 | PE3 | PE1 | 220 | 0.3 | 3000 | 1.17 | — | — | — |
| C3 | 100/0 | CR | — | 230 | 0.3 | 1000 | 2.93 | 49 | 96 | 1.76 |
| C4 | 100/0 | CR | — | 230 | 0.4 | 1350 | — | 49 | 98 | — |
| C5 | 100/0 | CR | — | 230 | 0.6 | 2000 | 2.73 | 51 | 97 | — |

The effect of draw force was also examined by varying throughput and spinning speed for the various fibers. This produced fibers of different denier.

Figure 5:
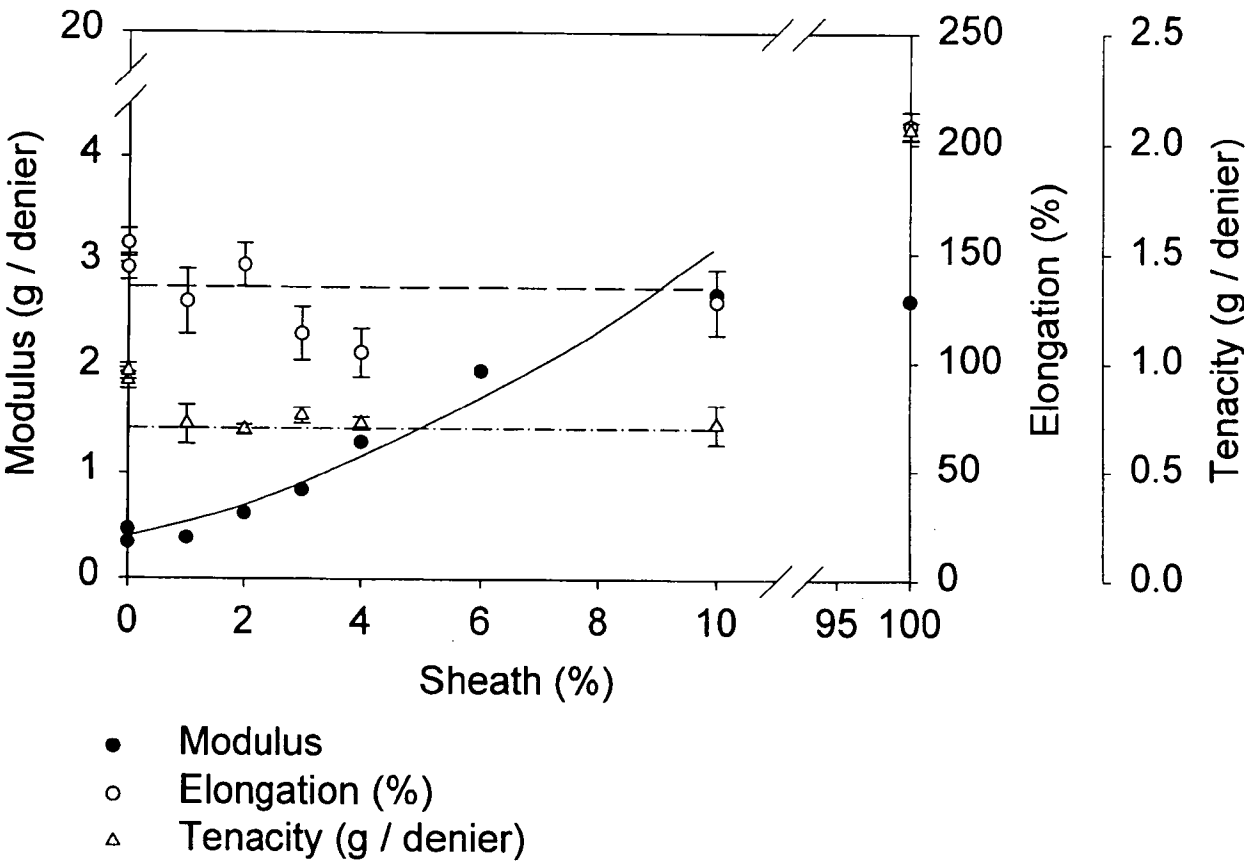
FIG. 5 is a graph plotting the tenacity, modulus and elongation for inventive conjugate fibers (examples 1-01 to 1-06) and comparative examples (C1, C2, C4, and C5).

FIG. 5 illustrates the effect of sheath content on modulus, tenacity and elongation to break. Modulus is shown to increase with increasing amounts of component A. Addition of a harder, more crystalline component is a common strategy for increasing modulus of a softer material. However, addition of a harder second phase can often reduce these ultimate properties. These examples however show that addition of component A up to about 10 wt % does not significantly affect elongation and tenacity. It is therefore novel that ultimate properties are not affected by component A in these fibers.

Figure 6:
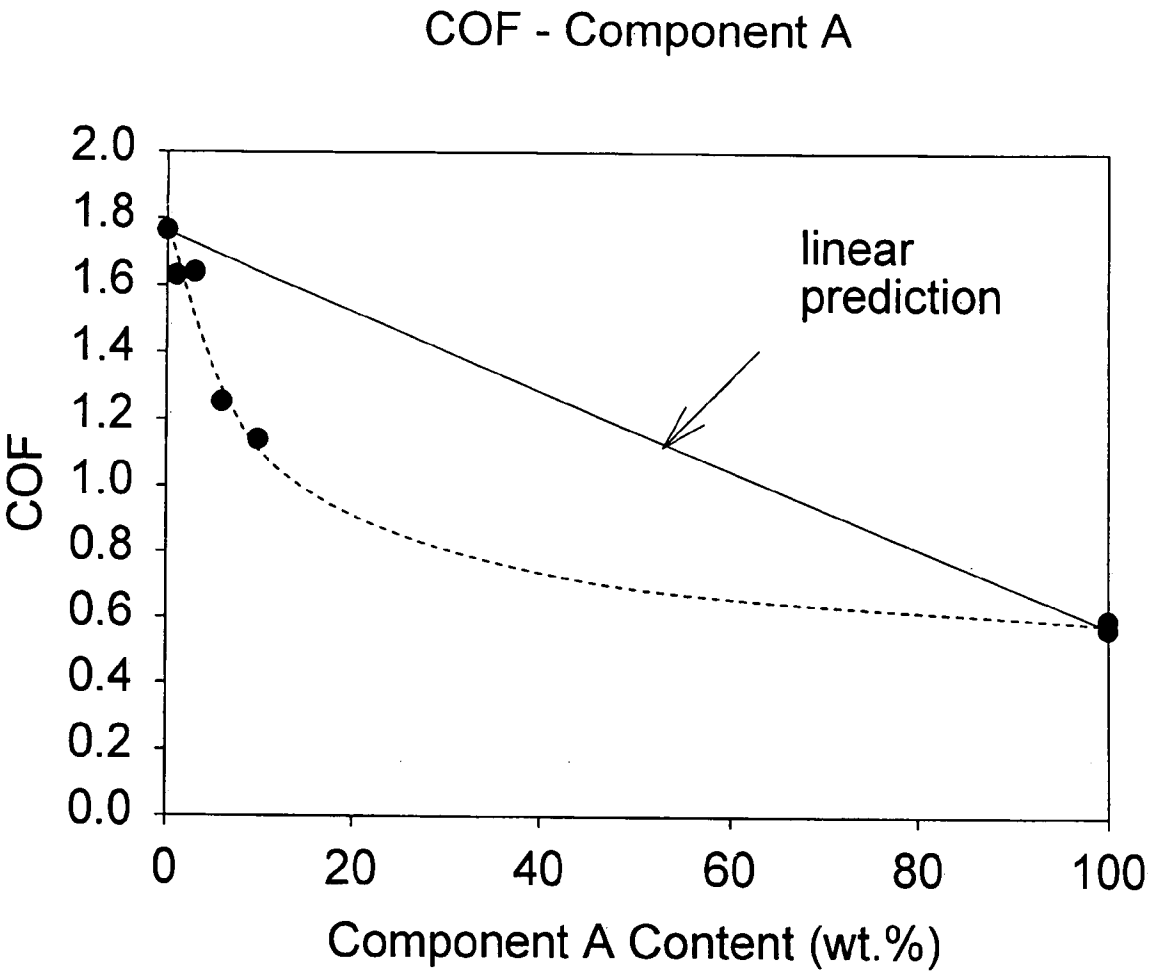
FIG. 6 is a graph plotting the COF for inventive conjugate fibers (examples 1-01 to 1-06) and comparative examples (C1, C2 and C3).

FIG. 6 shows the effect of sheath content on COF. Increasing PP1 content decreases the COF and describes a line with positive curvature. This relationship falls below the linear prediction for a blend and gives evidence that COF is lower than expected. Lower COF for hygiene article comdeform and recover more freely thereby imparting the novel combination of "non-sticky" hand feel and elastic performance. In all cases feel of resulting webs was improved over elastic homopolymer fiber webs having similar elastic properties.

Based on the COF test described above, the feel results were obtained for samples of webs formed from fibers of Runs 1–01 through 1–10 as shown in Table 1.

Example 2

Using an arrangement generally as in FIG. 1, employing conditions 25 HPI pack, 390° F. melt temperature, 0.6 grams/hole/minute, fiber draw unit 4 psi, bond temperature of 150° F., calender roll wire weave pattern as described above, a spunbond web of about 1 osy (34 gsm) basis weight was produced (Table 3).

TABLE 3

| Example | Sheath (%) | | Core (%) | | Peak Extension (%) CD | Peak Extension (%) MD | 1-Cycle Immediate Set (%) CD | 1-Cycle Immediate Set (%) MD | Peak Load (lb) CD | Peak Load (lb) MD | COF (Web) | ΔH (J/g) | $\Delta H_{PA}$ (80° C.) (%) |
|---|---|---|---|---|---|---|---|---|---|---|---|---|---|
| C6 | 0 | — | 100 | PE3 | 422 | 224 | 19 | — | 2.2 | 7.9 | 2.15 | 31 | 49 |
| 2-1 | 10 | PE1 | 90 | PE3 | 297 | 125 | 35 | 16 | 1.5 | 6.3 | 1.35 | 38 | 41 |
| 2-2 | 10 | PP1 | 90 | PE3 | 85 | 122 | 29 | 26 | 3.3 | 7.5 | 1.41 | 41 | 35 |
| 2-3 | 10 | PE1 | 90 | PE2 | 139 | 131 | 40 | 35 | 3.8 | 9.3 | 1.15 | 54 | 43 |
| C7 | 0 | — | 100 | PE2 | 278 | 168 | 33 | 26 | 3.3 | 8.6 | 2.17 | 46 | 48 |
| C8 | 0 | — | 100 | PP1 | 70 | 43 | — | — | 3.8 | 13.5 | 0.53 | — | — |

The polypropylene sheath and plastomer sheath materials both demonstrated cloth-like feel, but the plastomer sheath embodiment of example 2-1 to 2-3 demonstrated both excellent elasticity and pleasing hand properties. In addition, using resins for both components with similar rates of crystallization and thermal behavior may provide process (quench, spinning, more uniform drawing, bonding and quench) as well as providing material benefits.

Figure 8:
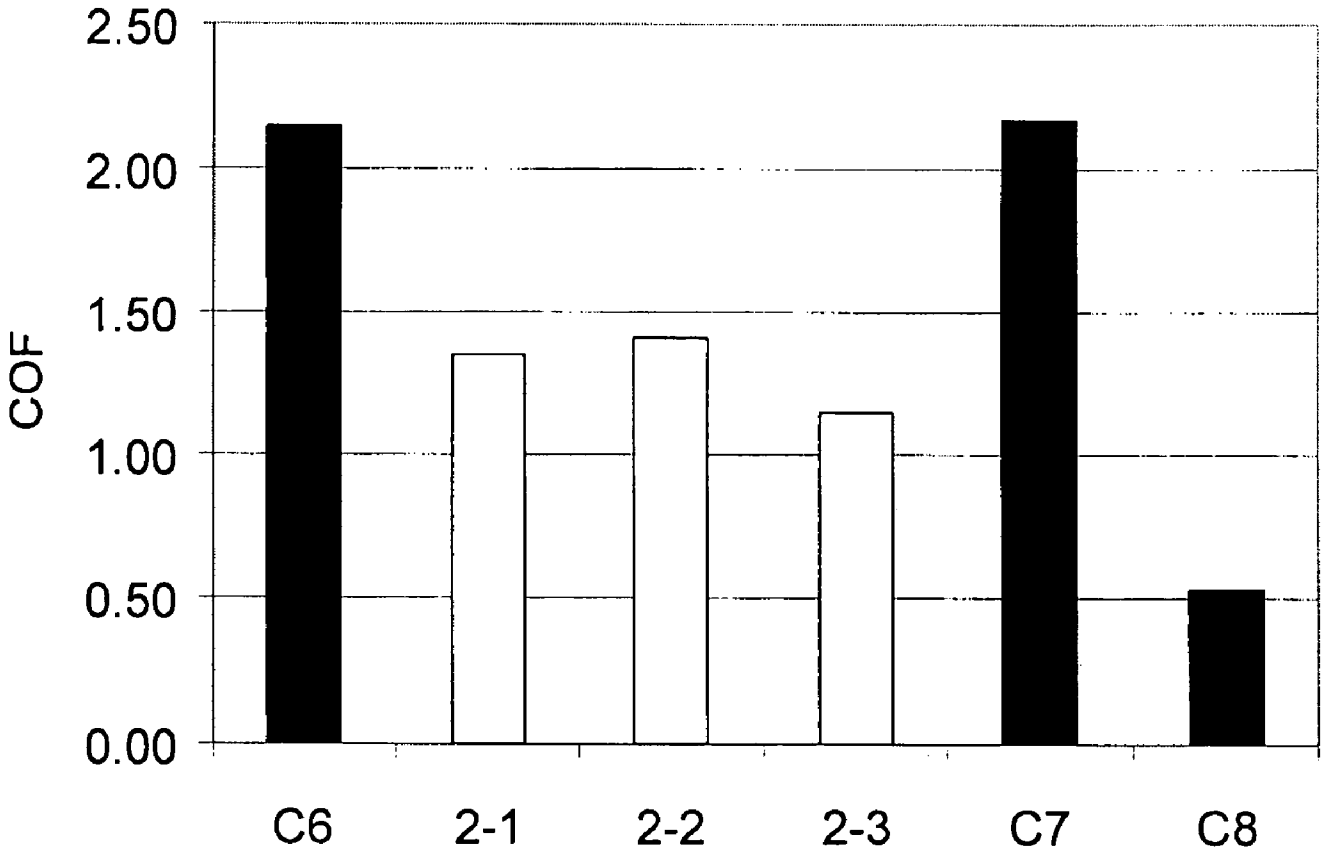
FIG. 8 is a graph showing the COF of various inventive fabrics and comparative examples.

FIG. 8 shows the COF of various fabrics in accordance with the invention and comparative examples. It is evident that examples 2-1 and 2-2 offer lower COF than a pure PE3 fabric (C6). Example 2-3 offers lower COF than pure PE2 fabric (C7).

Part of the good hand feel is attributed to the corrugated sheath structure (FIG. 3B). In varying the composition of the base resins used in the sheath and the core, it is evident that the modulus and difference in modulus affects the degree of corrugation.

Example 3

Using a Hills arrangement as described in Example 1, fibers with an effective heterophasic sheath were provided as indicated in the following Table 4:

TABLE 4

| Example | Core/Sheath | Core | Sheath | | Melt Temp (° C.) | Throughput (ghm) | Spinning Speed (m/min) | Denier per Filament (g/9000 m) | ΔH (J/g) | $\Delta H_{PA}$ (80° C.) (%) | COF |
|---|---|---|---|---|---|---|---|---|---|---|---|
| C9 | 100/0 | PE3 | — | — | 220 | 0.6 | 2000 | 2.30 | 29 | 50 | 1.29 |
| C10 | 100/0 | PE3 | — | — | 220 | 0.4 | 2000 | 2.04 | 32 | 48 | 1.28 |
| 3-01 | 90/10 | PE3 | 40/60 | PE3/PP1 | 220 | 0.4 | 2000 | 1.83 | 33 | 41 | — |
| 3-02 | 90/10 | PE3 | 60/40 | PE3/PP1 | 220 | 0.4 | 2000 | 2.47 | 34 | 43 | — |
| 3-03 | 85/15 | PE3 | 40/60 | PE3/PP1 | 220 | 0.4 | 2000 | 1.74 | 37 | 37 | 1.09 |
| 3-04 | 85/15 | PE3 | 60/40 | PE3/PP1 | 220 | 0.4 | 2000 | 1.79 | 35 | 40 | 0.96 |
| 3-05 | 90/10 | CR | 20/80 | PE2/PP1 | 230 | 0.4 | 1350 | 1.60 | 52 | 83 | — |
| 3-06 | 90/10 | CR | 40/60 | PE2/PP1 | 230 | 0.4 | 1350 | 0.89 | 52 | 85 | — |
| 3-07 | 90/10 | CR | 40/60 | PE2/PP1 | 230 | 0.4 | 1350 | 1.85 | 50 | 92 | — |
| 3-08 | 90/10 | CR | 60/40 | PE2/PP1 | 230 | 0.4 | 1350 | 3.10 | 54 | 87 | — |
| 3-09 | 90/10 | CR | 60/40 | CR/PP1 | 230 | 0.4 | 1350 | 3.10 | 52 | 92 | — |
| 3-10 | 90/10 | CR | 20/80 | CR/PP1 | 230 | 0.4 | 1350 | 3.30 | 53 | 84 | — |
| 3-11 | 90/10 | PE3 | 20/80 | PE3/RCP | 230 | 0.4 | 2000 | 1.94 | 29 | 47 | 0.89 |
| 3-12 | 90/10 | PE3 | 40/60 | PE3/RCP | 230 | 0.4 | 2000 | 1.68 | 27 | 49 | — |

Figure 9:
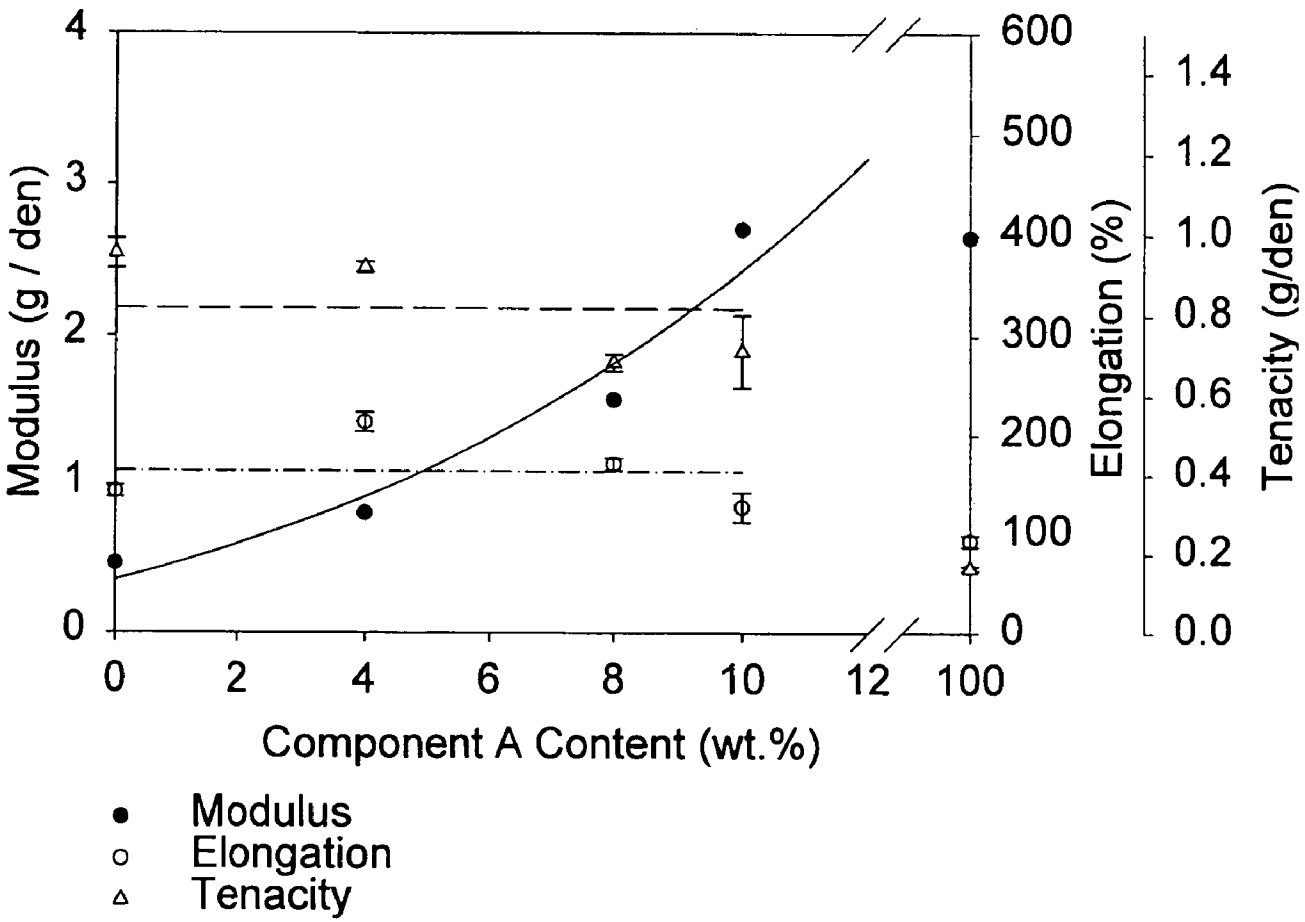
FIG. 9 is a graph plotting the tenacity, modulus and elongation for inventive conjugate fibers (examples 3-09 to 3-10) and comparative examples (C2 and C5).

Referring to FIG. 9, it can be seen that tensile responses for the sheaths of phase separated polymer blends shows increased modulus with increasing PP1 content. Like the examples corresponding to FIG. 5, these examples also show that the addition of component A up to about 10 wt. % does not have a significant effect on elongation and tenacity. It is therefore an important attribute that ultimate properties are not affected by component A in these fibers.

Figure 10:
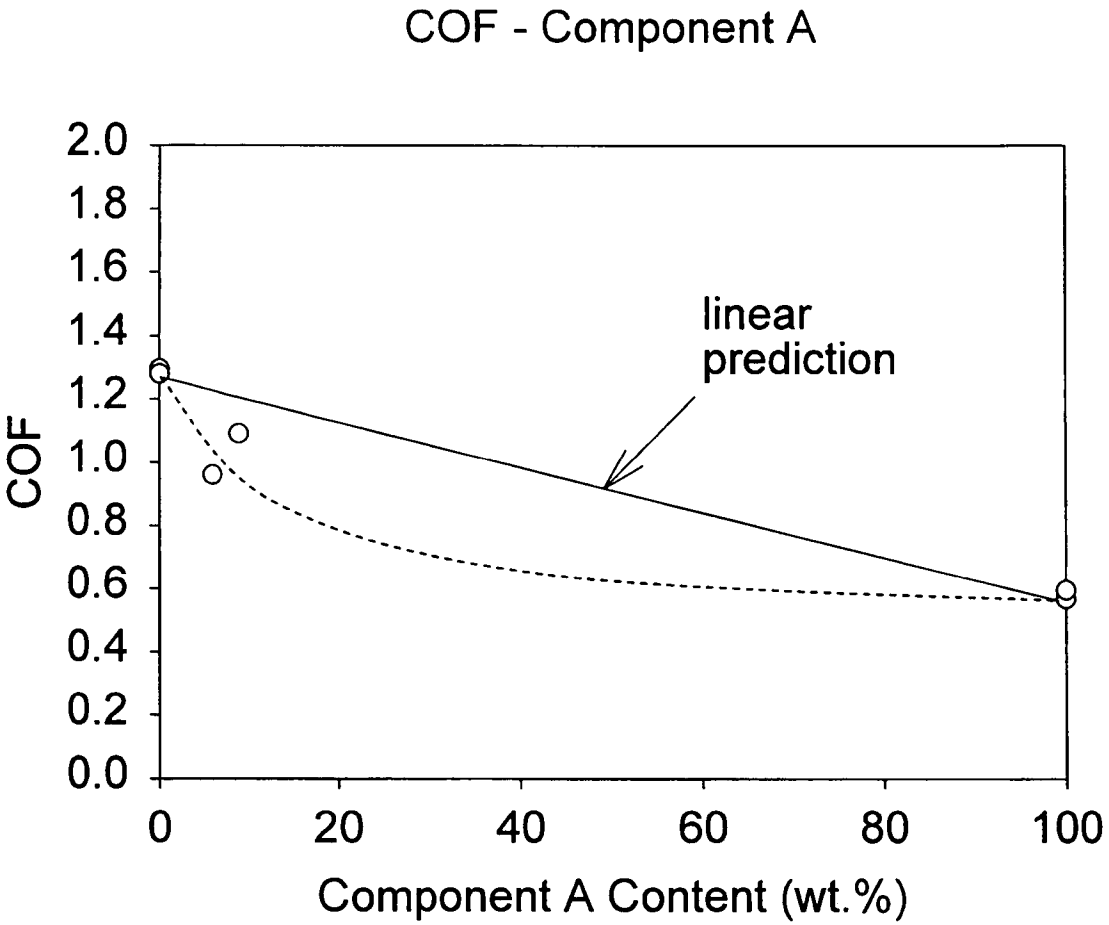
FIG. 10 is a graph plotting the COF for inventive conjugate fibers (examples 3-03 to 3-04) and comparative examples (C1, C2, C9, and C10).

Fibers were made with phase separated blends of PE3 and PP1 as component A and PE3 as component B. Increasing PP1 content decreases the COF and describes a line with positive curvature (FIG. 10). This relationship falls below the linear prediction for a blend and giving evidence that COF is lower than expected.

Mechanical properties of Examples 2 and 3 are summarized in Table 5.

TABLE 5

| Example | modulus (g/den) | Elongation (%) | Tenacity (g/den) | Load at 30% (g/den) | Unload at 30% (g/den) | Retained Load (%) | Set (%) |
|---|---|---|---|---|---|---|---|
| C1 | — | 208 | 2.06 | — | — | — | — |
| C2 | 2.6 | — | — | 1.43 | 0.140 | 10 | 16 |
| 1-01 | 0.4 | 127 | 0.71 | 0.27 | 0.060 | 23 | 2 |
| 1-02 | 0.6 | 144 | 0.69 | 0.29 | 0.060 | 20 | 4 |
| 1-03 | 0.8 | 113 | 0.75 | 0.30 | 0.059 | 20 | 3 |
| 1-04 | 1.3 | 104 | 0.71 | 0.34 | 0.057 | 17 | 4 |
| 1-05 | 2.0 | — | — | 0.33 | 0.055 | 17 | 6 |
| 1-06 | 2.7 | 127 | 0.71 | 0.36 | 0.045 | 13 | 10 |
| 1-07 | — | 150 | 1.40 | 0.40 | 0.099 | 25 | 8 |
| 1-08 | — | 104 | 2.19 | 1.08 | 0.120 | 11 | 3 |
| 1-09 | — | 94 | 2.30 | 1.24 | 0.254 | 20 | 8 |
| 1-10 | — | 64 | 2.00 | 1.33 | 0.140 | 10 | 9 |
| C3 | — | — | — | — | — | — | — |
| C4 | 0.47 | 143 | 0.95 | 0.30 | 0.125 | 42 | 5 |
| C5 | 0.34 | 154 | 0.91 | — | — | — | — |
| C9 | — | 121 | 2.31 | 0.70 | 0.130 | 18 | 5 |
| C10 | — | 121 | 1.95 | 0.55 | 0.090 | 17 | 8 |
| 3-01 | — | 81 | 2.10 | 1.15 | 0.230 | 20 | 7 |
| 3-02 | — | 100 | 2.30 | 0.70 | 0.100 | 14 | 7 |
| 3-03 | — | 106 | 2.50 | 1.21 | 0.224 | 19 | 9 |
| 3-04 | — | 96 | 2.60 | 1.31 | 0.238 | 18 | 8 |
| 3-05 | — | 127 | 0.72 | 0.49 | 0.151 | 31 | 9 |
| 3-06 | — | 94 | 0.85 | 0.73 | 0.255 | 35 | 8 |
| 3-07 | — | 136 | 0.87 | 0.34 | 0.134 | 39 | 4 |
| 3-08 | — | 123 | 0.87 | 0.43 | 0.114 | 27 | 6 |
| 3-09 | 0.81 | 213 | 0.92 | 0.26 | 0.107 | 42 | 5 |
| 3-10 | 1.57 | 171 | 0.68 | 0.34 | 0.094 | 28 | 8 |
| 3-11 | — | 95 | 2.40 | 1.00 | 0.210 | 22 | 5 |
| 3-12 | — | 89 | 2.50 | 1.21 | 0.249 | 21 | 4 |

Figure 11:
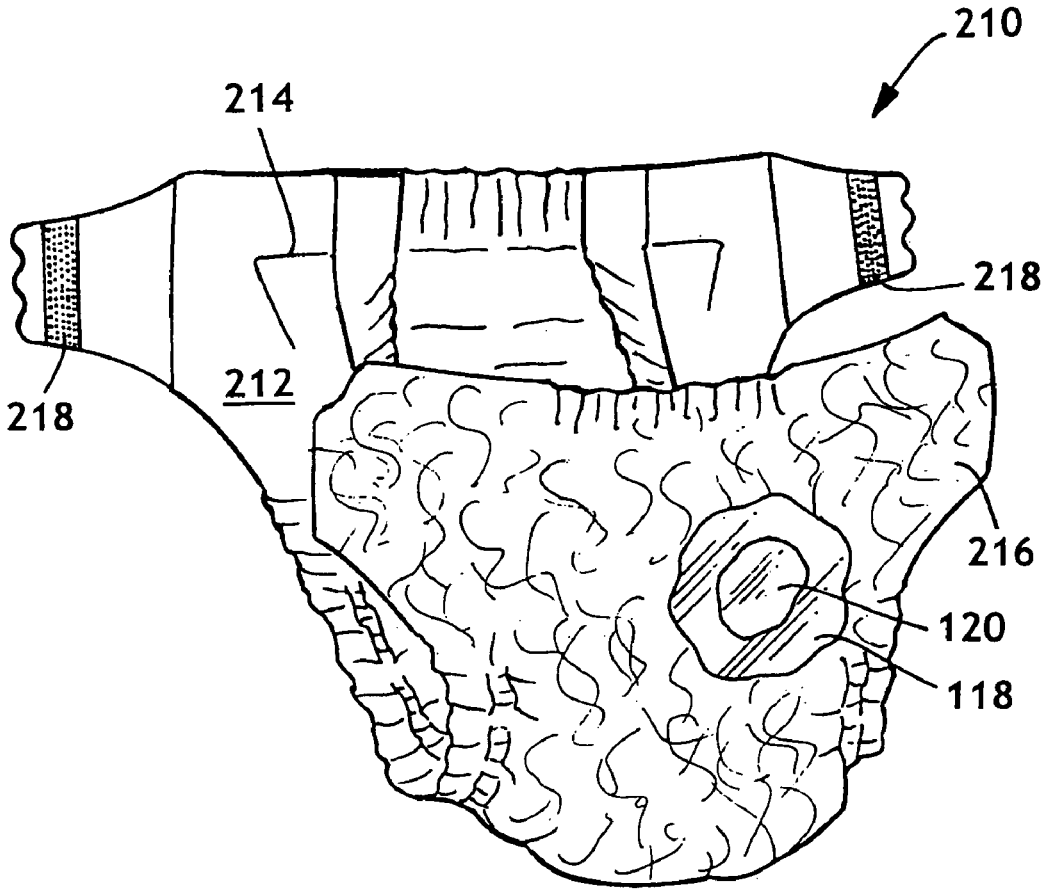
FIG. 11 is a schematic view of a personal care product in accordance with the invention.

Referring to FIG. 11, an example of a personal care product of the invention incorporating a conjugate fiber web of the invention is illustrated. Diaper 210 comprises liner 212 which can be a conjugate spunbond web in accordance with the invention. Liner 212 permits urine to pass through and be absorbed by absorbent 214 while the backing 216 (shown partially broken away to reveal layers 118 and 120 for clarity) is impervious to urine to help avoid leakage. The outer or exposed layer of liner 216 can also be a conjugate fiber web in accordance with the invention if desired. Some attachment means such as hook fastener elements 218 may be provided to engage the exposed layer of liner 216 or other loop receptive elements to provide fit on the wearer.

Numerous other personal care as well as additional applications will be apparent to those of skill in the art based on the above description. Particularly for low cost applications where some degree of stretch and/or elasticity is needed, the fibers and webs of the present invention are ideally suited. Examples in addition to components such as liners, backings, stretch waist and/or ear components of personal care products include sleeve and/or leg components of health care and protective garments, stretch to fit filter elements, and home furnishings, just to name a few.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

We claim:

1. An extensible conjugate fiber having a total heat of melting of less than about 80 Joules per gram, said fiber comprising:

a. from 0.001% to about 20% by weight of the total fiber of a first component A which comprises at least a portion of the fiber surface, said first component A comprising a polypropylene homopolymer or a propylene copolymer, b. and a second component B which comprises an elastic propylene-based olefin polymer.

2. An extensible conjugate fiber in accordance with claim 1 wherein the weight of component A is from about 0.001% to about 15% by weight at the total fiber.

3. An extensible conjugate fiber in accordance with claim 1 containing at least one component having a melting temperature greater than about 80° C.

4. An extensible conjugate fiber in accordance with claim 1 wherein said first component A comprises ripples, patches or fractures.

5. The extensible conjugate fiber of claim 1 having a total heat of melting of less than about 70 Joules per gram.

6. The extensible conjugate fiber of claim 1 wherein at least 5% of the heat of melting occurs below 80° C.

7. The extensible conjugate fiber of claim 1 wherein at least 40% of the heat of melting occurs below 80° C.

8. The extensible conjugate fiber of claim 1 wherein said component A and B each comprises a propylene alpha olefin copolymer with component A having at least 2 weight % less co-monomer man component B.

9. The extensible conjugate fiber of claim 8 wherein at least one of component A or component B contains at least 9% by weight co-monomer.

10. The extensible conjugate fiber of claim 1 wherein component A comprises at least a third of the fiber surface.

11. The extensible conjugate fiber of claim 10 wherein said component A forms a corrugated surface of the fiber.

12. The extensible conjugate fiber of claim 1 wherein said component A comprises less than 8% of said total fiber content by weight and forms a discontinuous surface of said fiber.

13. The extensible conjugate fiber of claim 1 wherein said component A comprises a blend of phase separated polymers forming sheath patches.

14. An extensible nonwoven fabric comprising melt extruded extensible conjugate fibers of claim 1.

15. An extensible nonwoven fabric comprising melt extruded, pneumatically drawn fibers of claim 10.

16. A nonwoven fabric as in claim 15 having a first cycle set less than about 40% when measured using the 1-cycle hysteresis test at 80% strain.

17. A nonwoven fabric as in claim 16 having a first cycle set less than about 15% when measured using the 1-cycle hysteresis test at 80% strain.

18. An extensible laminate comprising a nonwoven fabric nonwoven as in claim 16.

19. A personal care product comprising a nonwoven fabric as in claim 16.

20. A personal care product comprising the extensible laminate of claim 18.

* * * * *